US005374946A

United States Patent [19]

Shirakawa

[11] Patent Number: 5,374,946

[45] Date of Patent: Dec. 20, 1994

[54] SLIDING CONTACT PART FOR RECORDING MEDIUM

[75] Inventor: Takashi Shirakawa, Takizawa, Japan

[73] Assignee: Alps Electric Co., Ltd., Tokyo, Japan

[21] Appl. No.: 15,687

[22] Filed: Feb. 9, 1993

[30] Foreign Application Priority Data

| | | | |
|---|---|---|---|
| Feb. 20, 1992 | [JP] | Japan | 4-070313 |
| Mar. 26, 1992 | [JP] | Japan | 4-100584 |
| Jun. 15, 1992 | [JP] | Japan | 4-155169 |
| Jul. 9, 1992 | [JP] | Japan | 4-182284 |
| Oct. 26, 1992 | [JP] | Japan | 4-287521 |

[51] Int. Cl.[5] ..... B61J 2/335

[52] U.S. Cl. ..... 346/76 PH; 428/908.8

[58] Field of Search ..... 346/76 PH; 428/908.8

[56] References Cited

U.S. PATENT DOCUMENTS

| | | | |
|---|---|---|---|
| 4,587,400 | 5/1986 | Kanamori et al. | 346/76 PH |
| 4,595,823 | 6/1986 | Sorimachi et al. | 346/76 PH |
| 4,825,040 | 4/1989 | Kato | 346/76 PH |
| 4,827,289 | 5/1989 | Tsuji et al. | 346/76 PH |
| 4,862,195 | 8/1989 | Kato | 346/76 PH |
| 4,907,015 | 3/1990 | Kaneko | 346/76 PH |
| 4,968,992 | 11/1990 | Komuro | 346/140 R |
| 5,162,814 | 11/1992 | Shirakawa et al. | 346/76 PH |

FOREIGN PATENT DOCUMENTS

| | | |
|---|---|---|
| 0052672 | 3/1984 | Japan . |
| 0114668 | 5/1988 | Japan . |

*Primary Examiner*—Benjamin R. Fuller
*Assistant Examiner*—Huan Tran
*Attorney, Agent, or Firm*—Guy W. Shoup; Patrick T. Bever

[57] ABSTRACT

A wear resistance layer is formed on a surface of a portion of a sliding contact part adapted to contact with a recording medium and slide relative thereto. The wear resistance layer is formed of a material mainly composed of chromium oxide and at least one of conductive nitride and conductive carbide. Accordingly, the wear resistance of the sliding contact part can be greatly improved to thereby extend the service life.

9 Claims, 2 Drawing Sheets

SLIDING CONTACT PART FOR RECORDING MEDIUM

BACKGROUND OF THE INVENTION

1. Field of the Invention

The present invention relates to a sliding contact part for a recording medium, and more particularly to a sliding contact part such as a thermal head or a magnetic head adapted to contact with a recording medium in the form of a tape, disk or sheet and slide relative thereto.

2. Description of the Prior Art

Now commercially available are various devices for performing recording or reproduction with use of a recording medium such as a magnetic layer carrying sheet or film or a sheet of paper. Such recording/reproducing devices employ many parts adapted to always or temporarily slide on the recording medium relative thereto. This kind of parts includes a head slider for a flexible disk, a flying slider for a hard disk, a thermal head of a thermal printer, or a magnetic head. These parts are required not to damage the recording medium and to have a superior durability such that no wearing occurs even in long-term use.

Such a sliding contact part has a portion adapted to contact with the recording medium and slide :relative thereto. The sliding contact portion is covered with a wear resistance layer for suppressing wear of the sliding contact portion. The wear resistance layer is formed of a material such as $Ta_2O_5$ or $SiO_2$, but the wear resistance is insufficient.

Now, a conventional thermal head as an example of such a sliding contact part will be described in detail.

In general, a thermal head has the advantages of low noise, low cost, maintenance saving, power saving and high print quality. Then, in recent years, a thermal head has widely been applied to various recording equipments such as facsimiles and printers for word processors. On the other hand, these equipments have been increasingly demanded to have the performances of compact size, low cost, power saving, high print quality and long service life. Accordingly, the thermal head is also demanded to enhance its performances of compact size, low cost, high efficiency, high print speed, high print quality and long service life.

In particular, the performances of high print speed, high print quality and long service life are strongly demanded in the thermal head for the thermal printer. The high print speed and the high print quality are realized by designing the shape of the thermal head so as to project heating elements for effecting printing on the recording medium and by using means for increasing the contact pressure of the heating elements against the recording medium.

In the thermal head thus improved in print speed and print quality, however, the heating elements projected are remarkably worn by the increased contact pressure against the recording medium, causing the service life of the thermal head to become very short. To cope with this problem, it is essential to provide a protective layer superior in wear resistance on the thermal head.

Conventionally, such a protective layer used for a thermal head is formed of $Ta_2O_5$, SiC, Si-O-N, SiAlON, etc. However, these materials are inferior in wear resistance against a thermal recording paper in particular. Thus, the conventional thermal head has a serious problem that the even balance between print quality and service life cannot be obtained. The inferiority in wear resistance of the protective layer in the conventional thermal head is considered to be due to the fact that the material (e.g., $Ta_2O_5$) of the protective layer is apt to be broken by the friction to the material (e.g., $CaCO_3$ or $SiO_2$) contained in the thermal recording paper.

In order to extend the service life of the thermal head at the sacrifice of the print quality, it has been tried to reduce an amount of projection of the heating elements to thereby increase a contact area of portions other than the heating element adapted to contact with the recording medium, or reduce the contact pressure against the recording medium, or increase the film thickness of the protective layer, thus suppressing the wear of the protective layer. However, as especially in a thermal transfer printer using an ink ribbon for a word processor, it is demanded to realize high print quality on a post card, a so-called rough paper having a low surface smoothness, etc., but the high print quality cannot be expected because of the occurrence of blur or the like. Thus, the compatibility between high print quality and long service life cannot be attainable even by employing the above-mentioned means for extending the service life.

As mentioned above, the wear of the protective layer against a thermal recording paper is large in the conventional thermal head, and so the print quality in using an ink ribbon is necessarily reduced. Further, the demand for high-speed printing in the thermal printer has recently been increased to limit the shape of the thermal head and develop a reduction in print efficiency. Thus, the even balance between print quality and service life becomes further difficult to obtained.

While the above description has been directed to the conventional thermal head, other sliding contact parts in the prior art have similar defects such that the wear resistance is insufficient to shorten the service life.

SUMMARY OF THE INVENTION

It is accordingly an object of the present invention to provide a sliding contact part for a recording medium which can greatly improve the wear resistance and the durability of a sliding contact portion adapted to slldingly contact with the recording medium.

It is another object of the present invention to provide a thermal head which can effect good printing to a plain paper with use of an ink ribbon and ensure a superior wear resistance of the protective layer even in the case of using a thermal recording paper.

It is still another object of the present invention to provide a sliding contact part adapted to contact with a recording medium and slide relative thereto, wherein a wear resistance layer is formed on a surface of a portion of the sliding contact part adapted to contact with the recording medium, the wear resistance layer being formed of a material mainly composed of chromium oxide and at least one of conductive nitride and conductive carbide.

It is a further object of the present invention to provide a thermal head comprising a substrate, a heat retaining layer formed on a surface of the substrate, a plurality of heating elements formed on an upper surface of the heat retaining layer, a plurality of individual electrodes formed on the upper surface of the heat retaining layer so as to be individually connected to the heating elements, a common electrode formed on the upper surface of the heat retaining layer so as to commonly connected to the heating elements, and a protective layer formed so as to cover at least :the heating elements, the protective layer being formed of a material mainly composed of chromium oxide and at least one of conductive nitride and conductive carbide.

It is a still further object of the present invention to provide a thermal printer having a thermal head comprising a substrate, a heat retaining layer formed on a surface of the substrate, a plurality of heating elements formed on an upper surface of the heat retaining layer, a plurality of individual electrodes formed on the upper surface of the heat retaining layer so as to be individually connected to the heating elements, a common electrode formed on the upper surface of the heat retaining layer so as to commonly connected to the heating elements, and a protective layer formed so as to cover at least the heating elements, the protective layer being formed of a material mainly composed of chromium oxide and at least one of conductive nitride and conductive carbide.

Other objects and features of the invention will be more fully understood from the following detailed description and appended claims when taken with tile accompanying drawings.

DETAILED DESCRIPTION OF THE=PREFERRED EMBODIMENTS

A preferred embodiment of the present invention will now be described with reference to the drawings.

Figure 1:
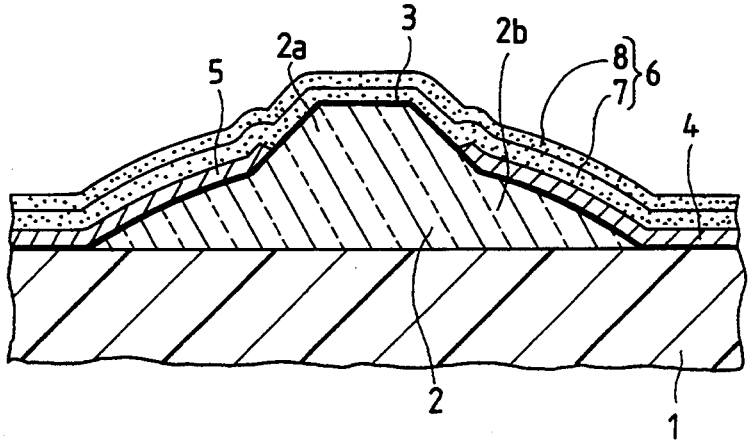
FIG. 1 is a vertical sectional view of a preferred embodiment of a thermal head according to the present invention.

Referring to FIG. 1 which shows a preferred embodiment of the present invention applied to a thermal head, reference numeral 1 designates an insulating substrate formed of ceramics such as alumina. A glazed layer 2 functioning as a heat retaining layer is formed on the insulating substrate 1. The glazed layer 2 is formed of glass or the like. The glazed layer 2 has a double-stepped convex shape as viewed in vertical section. That is, the glazed layer 2 consists of a lower convex portion 2*b* formed on the insulating substrate 1 and an upper projecting portion 2*a* formed at the top of the lower convex portion 2*b*. The lower convex portion 2*b* has an arcuate upper surface, and the upper projecting portion 2*a* has a substantially trapezoidal cross section. A plurality of heating elements 3 are formed on the upper surface of the upper projecting portion 2*a* of the glazed layer 2 according to the number of dots so as to be arranged in line. The heating elements 3 are formed by depositing a resistance heating material such as $Ta_2N$ on the upper surface of the glazed layer 2 by vapor deposition, sputtering, etc. and then etching the film of the resistance heating material. A common electrode 4 is formed on the upper surface of the glazed layer 2 so as to be commonly electrically connected to all the heating elements 3 on one side thereof. A plurality of individual electrodes 5 are also formed on the upper surface of the glazed layer 2 so as to be individually electrically connected to all the heating elements 3 on the other side thereof. The common electrode 4 and the individual electrodes 5 are formed by depositing a conductive material such as aluminum or copper by vapor deposition, sputtering, etc. and then etching the film of the conductive material to form a pattern having a desired shape.

Furthermore, a protective layer 6 having a thickness of about 7 to 10 μm for protecting the heating elements 3 and the electrodes 4 and 5 is formed on the surfaces of the heating elements 3 and the electrodes 4 and 5 and the surfaces of exposed portions of the insulating substrate 1 and the glazed layer 2. That is, the protective layer 6 is so formed as to cover the surfaces of all the portions except terminal portions of the electrodes 4 and 5.

The protective layer 6 consists of an oxidation resistance layer 7 having a thickness of 2 to 5 μm as a lower layer and a wear resistance layer 8 having a thickness of 2 to 8 μm as an upper layer formed on the upper surface of the oxidation resistance layer 7. The oxidation resistance layer 7 is formed of $SiO_2$, for example. The wear resistance layer 8 is formed of a material mainly composed of chromium oxide and at least one of conductive nitride such as chromium nitride (CrN, $Cr_2N$) or titanium nitride (TiN) and conductive carbide such as chromium carbide (CrC) or titanium carbide (TiC). The protective layer 6 may consist of the wear resistance layer 8 only, but is more preferably formed as a dual-layer structure consisting of the oxidation resistance layer 7 and the wear resistance layer 8.

It is to be noted that the conductive nitride or the conductive carbide to be used as a component of the material of the wear resistance layer in the present invention is not limited to the nitride of Ti or Cr or the carbide of Ti or Cr. Other examples of the conductive nitride or the conductive carbide may include nitrides or carbides of high-melting point metals such as Zr, Ta, V, Hf, Nb, W and Mo.

It has been found from a wear resistance test that the conductive nitride such as chromium nitride or titanium nitride or the conductive carbide such as chromium carbide or titanium carbide is superior in wear resistance to a thermal recording paper to the extent three to five times as that of the conventional materials. However, most of the conductive nitride and the conductive carbide have a large electrical conductivity, that is, a low resistivity (e.g., CrN: 600 μΩ·cm; $Cr_2N$: 80 μΩ·cm; TiN: 60 μΩ·cm; and TiC: 60 μΩ·cm). Therefore, if the conductive nitride or carbide is solely used as the material of the protective layer, there occurs short-circuit between the electrodes to cause no serviceability as a thermal head. In view of this problem, according to the present invention, chromium oxide is used as an optimum material capable of increasing an electrical resistance of the conductive nitride or carbide without reducing the superior wear resistance thereof. That is, chromium oxide and conductive nitride or carbide are used as a primary component of the material of the wear resistance layer. The thickness of the wear resistance layer in the present invention is set to preferably 7 to 10 μm more preferably 2 to 8 μm as depending upon kinds and materials of the thermal head to be used.

It is to be noted that the above discussion holds good also in the case where the materials of tile wear resistance layer is applied to other sliding contact parts.

The wear resistance layer is preferably formed from a sputtering target composed of about 20 to 50 mol % of the conductive nitride or the conductive carbide, about 0 to 5 mol % of a sintering assistant such as $Y_2O_3$ or $CeO_2$, and a remaining proportion of the chromium oxide. By setting the composition of the sputtering target to the above ratio, both the wear resistance and the electrical resistance of the wear resistance layer can be made fall within a utility range as in use for a thermal head. This is considered]to be due to the fact that a fine structure and a crystal grain size of the film mainly composed of the chromium oxide and the conductive nitride or the conductive carbide are maintained so as to provide suitable values of the wear resistance and the electrical resistance.

The present invention will be more clearly understood with reference to the following examples.

EXAMPLE 1

First, a sputtering target for forming the wear resistance layer 8 was prepared in the following manner. That is, 55 mol % of $Cr_2O_3$ powder (average particle size of 0.5 μm), 40 mol % of CrN powder (average particle size of 5 μm) and 5 mol % of $Y_2O_3$ (average particle size of 4 μm) were mixed together. The mixture thus obtained was homogenized in ethanol for 12 hours by using a ball mill, and then dried. Then, the mixture was molded at about 1500° C. for 2 hours in an atmosphere of Ar gas by using a hot press, and the molded part thus obtained was ground by a diamond dresser. Thus, the sputtering target of $\phi 203 \times 6^t$ was prepared.

Then, a thermal head was prepared in the following manner. That is, the lower convex portion 2b of the glazed layer 2 was formed on a part of the upper surface of the insulating substrate 1 having a good heat conductivity, such as alumina, and the upper projecting portion 2a of the glazed layer 2 was formed to have a height of about 10 μm at the top of the lower convex portion 2b by a print burning process. Then, a film of a resistance heating material was formed on the glazed layer 2 by sputtering, and a film of an electrically conductive material was formed on the film of the resistance heating material by sputtering, Then, the laminated films of the resistance heating material and the electrically conductive material were patterned by photolithography to form the heating elements 3 and the electrodes 4 and 5. Then, the oxidation resistance layer 7 of $SiO_2$ or the like was formed by sputtering to have a thickness of about 3 μm on the heating elements 3 and the electrodes 4 and 5, and the wear resistance layer 8 was formed to have a thickness of about 3 μm on the oxidation resistance layer 7 by sputtering in an atmosphere of Ar gas with use of the sputtering target composed of Cr-O-N prepared above, thus forming the protective layer 6. Thus, the thermal head was prepared.

Figure 2:
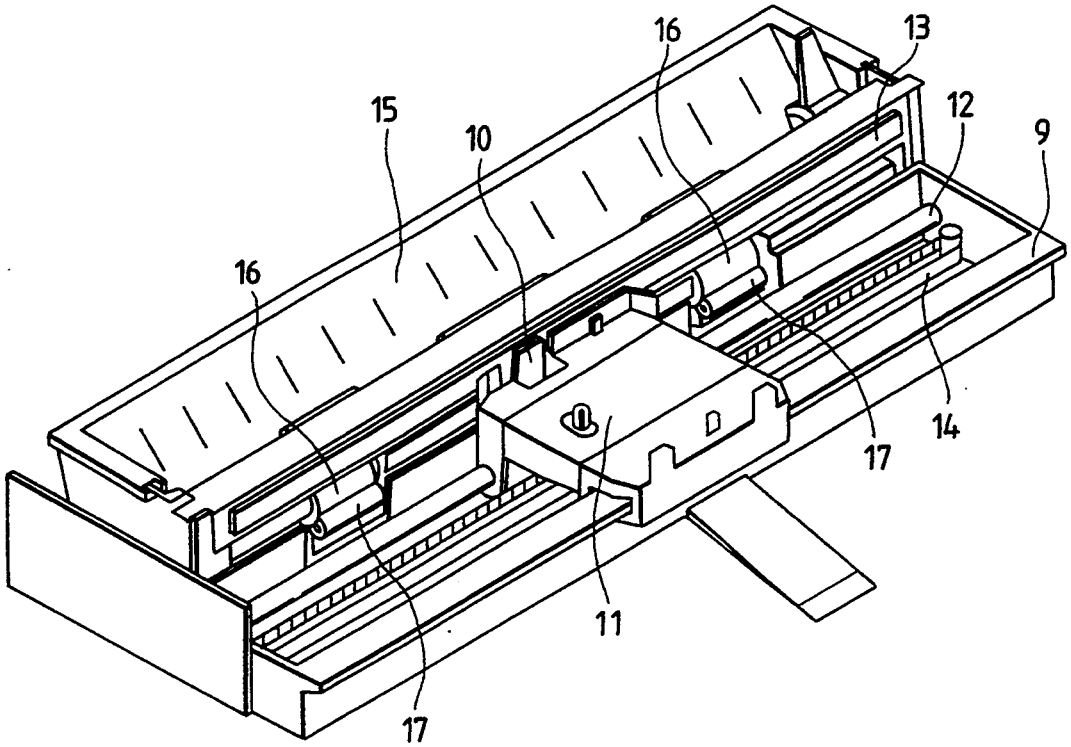
FIG. 2 is a general perspective view of a preferred embodiment of a thermal printer according to the present invention.

Then, the thermal head was mounted to a thermal printer as shown in FIG. 2 to carry out an actual print test.

The thermal printer shown in FIG. 2 includes a frame 9 as a base, a carriage 11 supported to the frame 9 so as to be reciprocatable along a shaft 12 extending in a longitudinal direction of the frame 9, a thermal head 10 mounted on the carriage 11, a platen 13 extending in the longitudinal direction of the frame 9 so as to face the thermal head 10, and a timing belt 14 for driving the carriage 11. An ink ribbon or a recording paper is adapted to be interposed between the thermal head 10 and the platen 13, and the thermal head 10 is adapted to come into pressure contact with the platen 13 through the ink ribbon or the recording paper. When the timing belt 14 is driven under the condition where the thermal head 10 is in pressure contact with the platen 13, the carriage 11 is reciprocated along the shaft 12 to thereby effect desired printing.

The recording paper is adapted to be introduced from a paper guide 15 into the thermal printer and be sequentially fed by paper feed rollers 16 and small rollers 17 to a desired print position.

Figure 3:
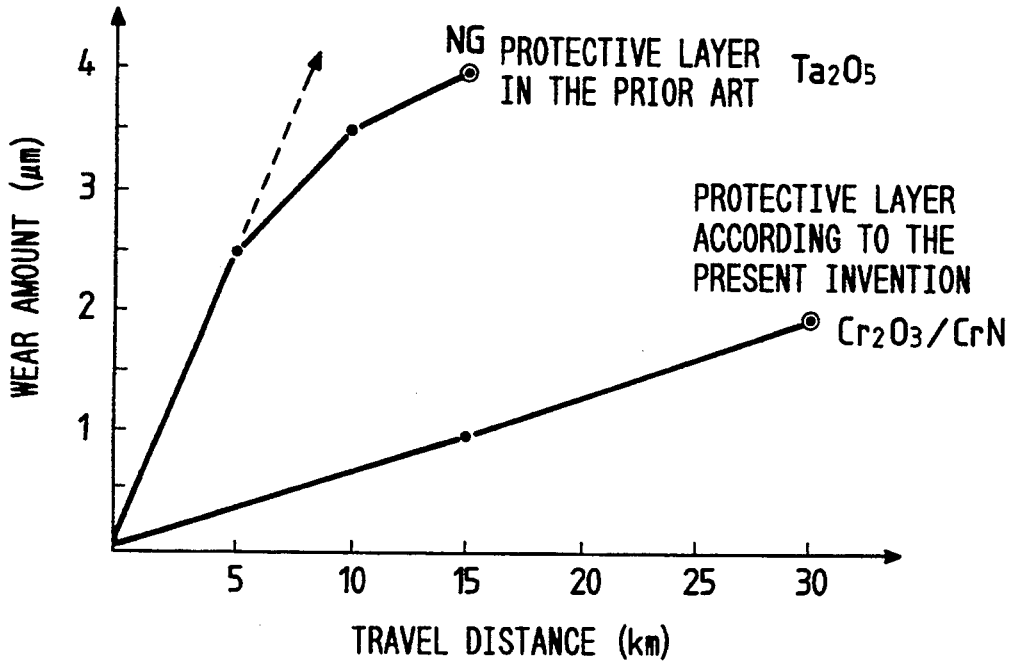
FIG. 3 is a graph showing the relation between a travel distance of the thermal head and a wear amount of a protective layer according to the preferred embodiment of the present invention in printing to a thermal recording paper, in comparison with the prior art.

Using the thermal printer mentioned above and a thermal recording paper (trade number: TP50KH-FS) manufactured by Jujo Seishi K.K., the actual print test was carried out under the conditions that a printing speed was set to 50 cps (characters per second) and a pressure contact force of the thermal head to the platen was set to 450 g. Then, tile test result shown in FIG. 3 was obtained. In FIG. 3, there is also shown for comparison the test result obtained by using the conventional protective layer formed of $Ta_2O_5$. As apparent from FIG. 3, a wear rate of the conventional protective layer decreases from a point corresponding to a travel distance of about 5 km. This is due to the fact that wearing of a projecting portion of a thermal head was proceeded to cause a rapid increase in contact area of the thermal head itself and decreases the wear rate as a whole. To the contrary, it is :appreciated that the protective layer in tile present invention has a superior wear resistance about five times that of the conventional protective layer. Further, a Vickers hardness Hv of the protective layer in the present invention was 1500, and crystallization of the protective layer in tile present invention was confirmed from X-ray diffraction data. Accordingly, it is considered that a fine structure of the protective layer in the present invention has become anisotropic.

The component, CrN of the sputtering target for forming the wear resistance layer in Example 1 has an important role. If the proportion of CrN is less than about 20 mol %, no crystallization occurs in the sputtered film to be formed as the wear resistance layer, causing a reduction in internal stress. Accordingly, a tensile stress acts on a base under the sputtered film to reduce the power resistance of the thermal head. This is considered to be due to the fact that the coefficient of thermal expansion of $Cr_2O_2$ (about $9 \times 10^{-6}$/° C.) is larger than tile coefficients of thermal expansion of the insulating substrate 1 and the glazed layer 2 ($6\text{–}7 \times 10^{-6}$/° C.) and that the internal stress of the sputtered film is small.

When the proportion of CrN is increased up to 20 mol %, the tensile stress is eliminated and a compressive stress to the base is increased to remarkably improve the power resistance of the thermal head. This is considered to be due to the fact that the coefficient of thermal expansion of CrN ($2.3 \times 10^{-6}$/° C.) and that crystallization occurs in the sputtered film to increase the internal compressive stress. However, if the proportion of CrN exceeds about 50 mol %, the electrical conductivity of the sputtered film becomes high, and the sputtered film in this case becomes unsuitable as the protective layer 6 of the thermal head. This is due to the fact that CrN is an electrically conductive material having a resistivity of 600 μΩ·cm. Consequently, it is preferable that the proportion of CrN for practical application to the thermal head is to be set to about 20 to 50 mol %.

As to the wear resistance, both $Cr_2O_3$ and CrN have a good wear resistance. However, it is necessary to maintain a film thickness of the protective layer 6 and prevent the generation of cracks in heat cycle in the case of application to the thermal head. Therefore, it is important to always apply a compressive stress to the protective layer 6. In this regard, CrN has an important role. Further, when the sum of the proportions of $Cr_2O_3$ and CrN is set to about 90 mol % or more, the wear resistance and the crack resistance become best. The larger the proportion of the sintering assistant such as $Y_2O_3$, $SiO_2$ or $CeO_2$ in the sputtering target, the lower the wear resistance.

EXAMPLES 2 TO 8

In the same manner as that in Example 1 with the exception that the composition of the sputtering target for forming the wear resistance layer is changed, thermal heads having different compositions were prepared, and the characteristics of the thermal heads were evaluated.

More specifically, 35 to 95 mol % of $Cr_2O_3$ powder (average particle size of 0.5 μm), 0 to 60 mol % of CrN powder (average particle size of 5 μm) and 5 mol % of $Y_2O_3$ (average particle size of 4 μm) were mixed together in different compositions such that the proportions of $Cr_2O_3$ and CrN were changed by steps of 10 mol %, thus preparing the thermal heads having different compositions.

Using these thermal heads, various tests concerning wear resistance, crack resistance and insulation were carried out to obtain the results shown in Table 1.

In Table 1, it is understood that the sum of the proportions of $Cr_2O_3$ and CrN is set to 95 mol % and the proportion of CrN is increased by steps of 10 mol % in the range of 0 to 60 mol %. Further, in Table 1, ○, Δ and × represent good, fair and poor conditions, respectively.

TABLE 1

| Example | Composition (mol %) $CR_2O_3$:CrN:$Y_2O_3$ | Characteristics Wear Resistance | Crack Resistance | Insulation |
|---|---|---|---|---|
| 2 | 95:0:5 | Δ | X | ○ |
| 3 | 85:10:5 | Δ | X | ○ |
| 4 | 75:20:5 | ○ | ○ | ○ |
| 5 | 65:30:5 | ○ | ○ | ○ |
| 6 | 55:40:5 | ○ | ○ | ○ |
| 7 | 45:50:5 | ○ | ○ | ○ |
| 8 | 35:60:5 | ○ | ○ | X |

In Example 2 where the ratio of $Cr_2O_3$, CrN and $Y_2O_3$ was set to 95:0:5 (mol %), no crystallization was confirmed in the sputtered film to reduce the wear resistance, and the compressive stress in the sputtered film was small to render the crack resistance insufficient. Thus, the thermal head in Example 2 is not applicable.

In Example 3 where the ratio of $Cr_2O_3$, CrN and $Y_2O_3$ was set to 85:10:5 (mol %), both the wear resistance and the crack resistance were insufficient as similar to Example 2. Thus, the thermal head in Example 3 is not applicable.

In Examples 4, 5, 6 and 7 where the proportions of CrN were set to 20, 30, 40 and 50 (mol %), respectively, crystallization was confirmed in each sputtered film to provide a good wear resistance, and the compressive stress in each sputtered film was large to render the crack resistance sufficient. Thus, the thermal heads in Examples 4 to 7 are applicable.

In Example 8 where the ratio of $Cr_2O_3$, CrN and $Y_2O_3$ was set to 35:60:5 (mol %), the insulation was insufficient. Thus, the thermal head in Example 8 is not applicable.

The sputtering target composed of Cr-O-N used in each example according to the present invention has a good sinterability. Accordingly, it is sufficient that the proportion of the sintering assistant is to be set to several mol % or less, thereby maintaining a sufficiently high wear resistance of the Cr-O-N sputtered film and a sufficiently high mechanical strength of the sputtering target.

As apparent from the above results, the thermal head in each example according to the present invention obviated all the problems in the conventional protective layer to greatly improve a service life in high-speed and high-quality printing.

EXAMPLE 9

First, a sputtering target for forming the wear resistance layer 8 was prepared in the following manner. That is, 70 mol % of $Cr_2O_3$ powder (average particle size of 0.5 μm) and 30 mol % of TiN powder (average particle size of 5 μm) were mixed together. The mixture thus obtained was homogenized in ethanol for 12 hours by using a ball mill, and then dried. Then, the mixture was molded at about 1500° C. for 2 hours in an atmosphere of Ar gas by using a hot press, and the molded part thus obtained was ground by a diamond dresser. Thus, the sputtering target of $\phi 203 \times 6^t$ was prepared.

Figure 4:
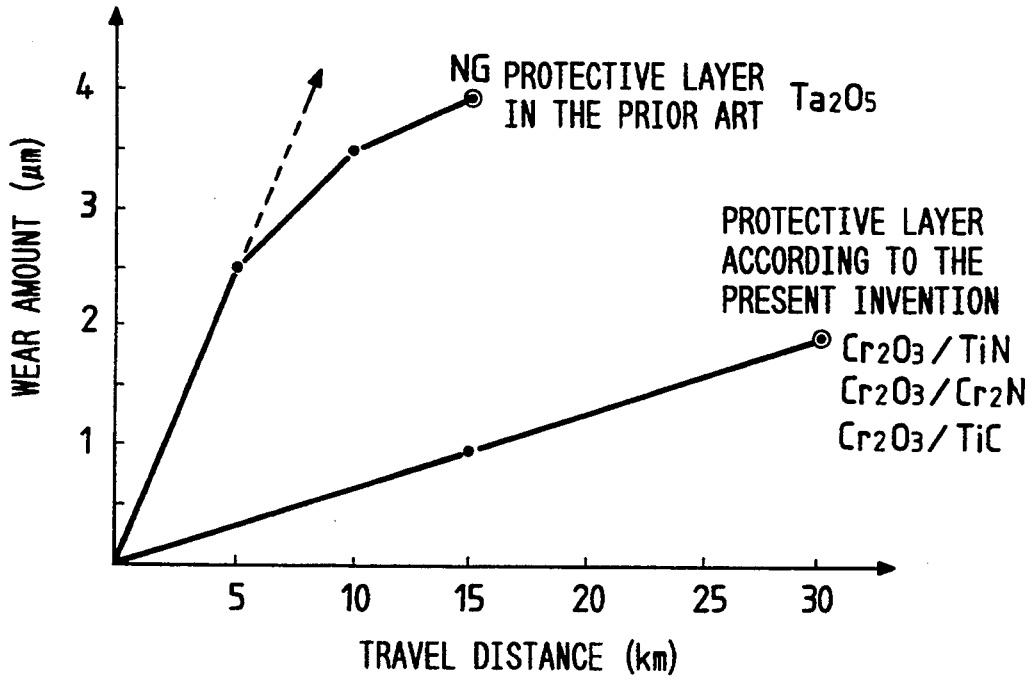
FIG. 4 is a graph showing the relation between a travel distance of a thermal head and a wear amount of a protective layer according to another preferred embodiment of the present invention in printing to a thermal recording paper, in comparison with the prior art.

Then, a thermal head was prepared in the same manner as that in Example 1. Using the thermal head prepared above, the actual print test was carried: out under the same conditions as those in Example 1 to obtain the result shown in FIG. 4. In FIG. 4, there is also shown for comparison the test result obtained by using the conventional protective layer formed of $Ta_2O_5$. As apparent from FIG. 4, it is appreciated that the protective layer in the present invention has a superior wear resistance about five times that of the conventional protective layer. Further, a Vickers hardness Hv of the protective layer in the present invention was 1500, and crystallization of the protective layer in the present invention was confirmed from X-ray diffraction data. Accordingly, it is considered that a fine structure of the protective layer in the present invention has become anisotropic.

The component, TiN of the sputtering target for forming the wear resistance layer in Example 9 has an important role. If the proportion of TiN is less than about 20 mol %, no crystallization occurs in the sputtered film to be formed as the wear resistance layer, causing a reduction in internal stress. Accordingly, a tensile stress acts on a base under the sputtered film to reduce the power resistance of the thermal head. This is considered to be due to the fact that the coefficient of thermal expansion of $Cr_2O_2$ (about $9 \times 10^{-6}$/° C.) is larger than the coefficients of thermal expansion of the insulating substrate 1 and the glazed layer 2 ($6$–$7 \times 10^{-6}$/° C.) and that the internal stress of the sputtered film is small.

When the proportion of TiN is increased up to 20 mol % the tensile stress is eliminated and a compressive stress to the base is increased to remarkably improve the power resistance of the thermal head. This is considered to be due to the fact that crystallization occurs in the sputtered film to increase the internal compressive stress. However, if the proportion of TiN exceeds about 40 mol %, the electrical conductivity of the sputtered film becomes high, and the sputtered film in this case becomes unsuitable as the protective layer 6 of the thermal head. This is due to the fact that TiN is an electrically conductive material having a resistivity of 100 $\mu\Omega$·cm. Consequently, it is preferable that the proportion of TiN for practical application to the thermal head is to be set to about 20 to 40 mol %.

As to the wear resistance, both $Cr_2O_3$ and TiN have a good wear resistance. However, it is necessary to maintain a film thickness of the protective layer 6 and prevent the generation of cracks in heat cycle in the case of application to the thermal head. Therefore, it is important to always apply a compressive stress to the protective layer 6. In this regard, TiN has an important role. Further, when the sum of the proportions of $Cr_2O_3$ and TiN is set to about 100 mol %, the wear resistance and the crack resistance become best. The larger the proportion of the sintering assistant such as $Y_2O_3$, $SiO_2$ or $CeO_2$ in the sputtering target, the lower the wear resistance. Further, in this example, since $Cr_2O_3$ has a good sinterability, a good sintered body as the sputtering target can be formed without using a sintering assistant, thereby sufficiently increasing the wear resistance of the sputtered film and the mechanical strength of the sputtering target.

EXAMPLES 10 TO 16

In the same manner as that in Example 9 with the exception that the composition of the sputtering target for forming the wear resistance layer is changed, thermal heads having different compositions were prepared, and the characteristics of the thermal heads were evaluated.

More specifically, 40 to 100 mol % of $Cr_2O_3$ powder (average particle size of 0.5 $\mu$m) and 0 to 60 mol % of TiN powder (average particle size of 5 $\mu$m) were mixed together in different compositions such that the proportions of $Cr_2O_3$ and TiN were changed by steps of 10 mol %, thus preparing the thermal heads having different compositions.

Using these thermal heads, various tests concerning wear resistance, crack resistance and insulation were carried out to obtain the results shown in Table 2.

In Table 2, it is understood that the sum of the proportions of $Cr_2O_3$ and TiN is set to 100 mol % and the proportion of TiN is increased by steps of 10 mol % in the range of 0 to 60 mol %. Further, in Table 2, ○, Δ and × represent good, fair and poor conditions, respectively.

TABLE 2

| Example | Composition (mol %) $Cr_2O_3$:TiN | Characteristics: Wear Resistance | Crack Resistance | Insulation |
|---|---|---|---|---|
| 10 | 100:0 | Δ | X | ○ |
| 11 | 90:10 | Δ | X | ○ |
| 12 | 80:20 | ○ | ○ | ○ |
| 13 | 70:30 | ○ | ○ | ○ |
| 14 | 60:40 | ○ | ○ | Δ |
| 15 | 50:50 | ○ | ○ | X |
| 16 | 40:60 | ○ | ○ | X |

In Example 10 where the ratio of $Cr_2O_3$ and TiN was set to 100:0 (mol %), no crystallization was confirmed in the sputtered film to reduce the wear resistance, and the compressive stress in the sputtered film was small to render the crack resistance insufficient. Thus, the thermal head in Example 10 is not applicable.

In Example 11 where the ratio of $Cr_2O_3$ and TiN was set to 90:10 (mol %), both the wear resistance and the crack resistance were insufficient as similar to Example 10. Thus, the thermal head in Example 11 is not applicable.

In Examples 12 and 13 where the proportions of TiN were set to 20 and 30 (mol %), respectively, crystallization was confirmed in each sputtered film to provide a good wear resistance, and the compressive stress in each sputtered film was large to render tile crack resistance sufficient. Thus, the thermal heads in Examples 12 and 13 are applicable. In Example 14 where the proportion of TiN was set to 40 mol %, the insulation was somewhat reduced, but the wear resistance and the crack resistance were good. Thus, the thermal head in Example 14 is usable.

In Example 15 where the ratio of $Cr_2O_3$ and TiN was set to 50:50 (mol %), the insulation was insufficient. Thus, the thermal head in Example 15 is not applicable. Also, in Example 16 where the ratio of $Cr_2O_3$ and TiN was set to 40:60 (mol %), the insulation was insufficient as similar to Example 15. Thus, the thermal head in Example 16 is not applicable.

Also in the case of substituting $Cr_2N$ for TiN as the conductive nitride, the test results similar to those shown in Table 2 were obtained.

Further, using a thermal head having a protective layer formed from a sputtering target composed of 70 mol % of $Cr_2O_3$ powder and 30 mol % of TiC powder as the conductive carbide, the actual print test similar to that in Example 9 was carried out to obtain the test result similar to that shown in FIG. 4. That is, it was confirmed that the protective layer in this case also has a good wear resistance about five times that of the conventional protective layer formed of $Ta_2O_5$. Further, in the case of changing the ratio of $Cr_2O_3$ and TiC in the same manner as in Examples 10 to 16, the test results similar to those shown in Table 2 were obtained. Accordingly, it is appreciated that TiN shown in Table 2 may be replaced by TiC. Further, although either the conductive nitride or the conductive carbide is used in the above preferred embodiment, both the conductive nitride and the conductive carbide may be used according to the present invention.

EXAMPLE 17

A wear resistance layer formed of a material mainly composed of chromium oxide and chromium nitride in the ratio similar to that in Example 1 was formed on the surface of a sliding contact portion of a head slider adapted to contact with a flexible disk.

Using this head slider, an endurance test was carried out. As the test result, it was confirmed that normal recording and reproduction could be effected without any trouble even after continuous operation for 200 hours.

Further, a wear resistance layer similar to the above was formed on the surface of a sliding contact portion of a flying slider adapted to contact with a hard disk, and an endurance test was carried out. As the test result, it was confirmed that normal recording and reproduction could be effected without any trouble even after continuous operation for 200 hours.

Further, a wear resistance layer similar to the above was formed on the surface of a sliding contact portion of a magnetic head adapted to contact with a magnetic tape, and an endurance test was carried out. As the test result, it was confirmed that a service life about twice that of a conventional magnetic head could be obtained.

As described above, according to the present invention, in a sliding contact part adapted to contact with a recording medium and slide relative thereto, a protective layer formed of a material mainly composed of chromium oxide and at least one of conductive nitride and conductive carbide is formed on a surface of a portion of the sliding contact part adapted to contact with the recording medium. Accordingly, the wear resistance of the sliding contact part can be greatly improved to thereby extend the service life.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A wear resistance layer for a sliding contact part, said wear resistance layer comprising chromium oxide and at least one of electrically conductive nitride and electrically conductive carbide.

2. The wear resistance layer as defined in claim 1, wherein said wear resistance layer mainly comprises chromium oxide and electrically conductive nitride, said electrically conductive nitride including an element selected from a group consisting of Cr, Ti, Zr, Ta, V, Hf and Nb.

3. The wear resistance layer as defined in claim 1, wherein said wear resistance layer mainly comprises chromium oxide and electrically conductive carbide, said electrically conductive carbide including an element selected from a group consisting of Cr, Ti, Zr, Ta, V, Hf and Nb.

4. A thermal head comprising a substrate, a heat retaining layer formed on a surface of said substrate, a plurality of heating elements formed on an upper surface of said heat retaining layer, a plurality of individual electrodes formed on said upper surface of said heat retaining layer so as to be individually connected to said heating elements, a common electrode formed on said upper surface of said heat retaining layer so as to commonly connected to said heating elements, and a protective layer formed over said heating elements, said protective layer comprising chromium oxide and at least one of electrically conductive nitride and electrically conductive carbide.

5. The thermal head as defined in claim 4, wherein said protective layer mainly comprises chromium oxide and electrically conductive nitride, said electrically conductive nitride including an element selected from a group consisting of Cr, Ti, Zr, Ta, V, Hf and Nb.

6. The thermal head as defined in claim 4, wherein said protective layer mainly comprises said chromium oxide and said electrically conductive carbide, said electrically conductive carbide including an element selected from a group consisting of Cr, Ti, Zr, Ta, V, Hf and Nb.

7. The thermal head as defined in claim 4, wherein said protective layer is formed by sputtering using a target containing 20 to 50 mol % of said electrically conductive nitride and 50 to 80 mol % of said chromium oxide, wherein a total amount of said electrically conductive nitride and said chromium oxide in said target is 90 to 100 mol %.

8. The thermal head as defined in claim 4, wherein said protective layer is formed by sputtering using a target containing 20 to 50 mol % of said electrically conductive carbide and 50 to 80 mold % of said chromium oxide, wherein a total amount of said electrically conductive carbide and said chromium oxide in said target is 90 to 100 mol %.

9. A thermal printer comprising:

a base;

a carriage slidably mounted to the base; and a thermal head mounted on the carriage, the thermal head including:

a substrate, a heat retaining layer formed on a surface of said substrate, a plurality of heating elements formed on an upper surface of said heat retaining layer, a plurality of individual electrodes formed on said upper surface of said heat retaining layer, each of said plurality of electrodes being connected to an associated one of said plurality of heating elements, a common electrode formed on said upper surface of said heat retaining layer and to all of said plurality of heating elements, and a protective layer formed over said hating elements, said protective layer comprising chromium oxide and at least one of electrically conductive nitride and electrically conductive carbide.

* * * * *